US010519628B2

(12) United States Patent
Kim et al.

(10) Patent No.: US 10,519,628 B2
(45) Date of Patent: Dec. 31, 2019

(54) CONTROL SYSTEM FOR CONSTRUCTION MACHINERY AND CONTROL METHOD FOR CONSTRUCTION MACHINERY

(71) Applicant: DOOSAN INFRACORE CO., LTD., Incheon (KR)

(72) Inventors: Ki-Yong Kim, Seoul (KR); Hyeon-Sik Ahn, Seoul (KR); Woo-Yong Jung, Seoul (KR); Chang-Mook Kim, Gyeonggi-do (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 15/723,360

(22) Filed: Oct. 3, 2017

(65) Prior Publication Data

US 2018/0094406 A1 Apr. 5, 2018

(30) Foreign Application Priority Data

Oct. 4, 2016 (KR) ..... 10-2016-0127409

(51) Int. Cl.
*E02F 9/22* (2006.01)
*B66F 9/22* (2006.01)
(Continued)

(52) U.S. Cl.
CPC ..... *E02F 9/2228* (2013.01); *B66F 9/22* (2013.01); *E02F 3/42* (2013.01); *E02F 3/43* (2013.01); *E02F 9/2004* (2013.01); *E02F 9/2029* (2013.01); *E02F 9/2203* (2013.01); *E02F 9/2235* (2013.01); *E02F 9/2267* (2013.01); *E02F 9/2271* (2013.01); *E02F 9/2285* (2013.01); *E02F 9/2292* (2013.01); *E02F 9/2296* (2013.01); *F15B 11/17* (2013.01);
(Continued)

(58) Field of Classification Search
CPC ..... E02F 9/2029; E02F 9/2235; E02F 9/2285; E02F 3/42; E02F 9/2228; F15B 11/044; F15B 11/17
See application file for complete search history.

(56) References Cited

U.S. PATENT DOCUMENTS 10,041,224 B2 * 8/2018 Kondo ..... E02F 9/2242
2016/0145835 A1 5/2016 Wook et al.

FOREIGN PATENT DOCUMENTS

EP 2985391 A1 2/2016
JP H11303814 A 11/1999
(Continued)

OTHER PUBLICATIONS

Extended European Search Report for related EP Application No. 17194790.6 dated May 11, 2018.

*Primary Examiner* — Abiy Teka
(74) *Attorney, Agent, or Firm* — K&L Gates LLP

(57) ABSTRACT

A control system for construction machinery includes a first hydraulic pump, first and second actuators connected to the first hydraulic pump through first and second hydraulic lines respectively, first and second control valves installed in the first and second hydraulic lines respectively and configured to control operations of the first and second actuators, and a controller configured to adjust a spool displacement amount of the first control valve according to an amount of working oil to be supplied to the first actuator when the first actuator performs a single or multiple operation by self-load.

12 Claims, 8 Drawing Sheets

(51) Int. Cl.

| | |
|---|---|
| ***E02F 9/20*** | (2006.01) |
| ***F15B 11/17*** | (2006.01) |
| ***E02F 3/42*** | (2006.01) |
| ***E02F 3/43*** | (2006.01) |
| *F15B 11/16* | (2006.01) |
| *F15B 13/06* | (2006.01) |

(52) U.S. Cl.
CPC ..... *F15B 11/16* (2013.01); *F15B 13/06* (2013.01); *F15B 2211/20576* (2013.01); *F15B 2211/3059* (2013.01); *F15B 2211/35* (2013.01); *F15B 2211/426* (2013.01); *F15B 2211/6346* (2013.01); *F15B 2211/665* (2013.01); *F15B 2211/6654* (2013.01); *F15B 2211/7051* (2013.01); *F15B 2211/71* (2013.01); *F15B 2211/75* (2013.01)

(56) References Cited

FOREIGN PATENT DOCUMENTS

| | | | |
|---|---|---|---|
| KR | 20160019895 | A | 2/2016 |
| WO | 2009084953 | A2 | 7/2009 |

* cited by examiner

CONTROL SYSTEM FOR CONSTRUCTION MACHINERY AND CONTROL METHOD FOR CONSTRUCTION MACHINERY

PRIORITY STATEMENT

This application claims priority under 35 U.S.C. § 119 to Korean Patent Application No. 10-2016-0127409, filed on Oct. 4, 2016 in the Korean Intellectual Property Office (KIPO), the contents of which are herein incorporated by reference in their entirety.

FIELD OF TECHNOLOGY

Example embodiments relate to a control system for construction machinery and a control method for construction machinery. More particularly, example embodiments relate to a control system for construction machinery including an electro-hydraulic main control valve using an electro proportional pressure reducing valve.

BACKGROUND

In an electronic control in construction machinery, an electro-hydraulic main control valve with an electro proportional pressure reducing valve (EPPRV) may be used. In conventional construction machinery, during an operation by self-load of an arm or bucket, an operating speed of a work device may be controlled by a meter-out opening area control. In this case, an orifice area curve was designed based on a case that an amount of a working oil supplied to an actuator (arm cylinder, bucket cylinder, etc) is a minimum amount or relatively smaller. Accordingly, during a load operation, not by an operation by self-load, back pressure may be increased to thereby deteriorate fuel efficiency due to pressure loss.

SUMMARY

Example embodiments provide a control system for construction machinery capable of improving fuel efficiency and work efficiency.

Example embodiments provide a control method for construction machinery using the above control system.

According to example embodiments, a control system for construction machinery includes a first hydraulic pump, first and second actuators connected to the first hydraulic pump through first and second hydraulic lines respectively and operable by a working oil discharged from the first hydraulic pump, first and second control valves installed in the first and second hydraulic lines respectively and configured to control operations of the first and second actuators, first spool displacement adjusting valves supplying a pilot signal pressure to a spool of the first control valve in proportion to an inputted control signal to control a displacement amount of the spool of the first control valve, and a controller configured to output the control signal to the first spool displacement adjusting valves corresponding to a manipulation signal of an operator, and configured to adjust a spool displacement amount of the first control valve according to an amount of the working oil to be supplied to the first actuator when the first actuator performs a single or multiple operation by self-load.

In example embodiments, the controller may output the control signal to a meter-out adjusting valve of the first spool displacement adjusting valves to perform a meter-out opening area control of the first control valve.

In example embodiments, the controller may adjust the spool displacement amount of the first control valve according to a first amount of the working oil to be supplied to the first actuator during a single operation of the first actuator, and may adjust the spool displacement amount of the first control valve according to a second amount of the working oil to be supplied to the first actuator during a multiple operation of the first actuator, the first amount of the working oil being greater than the second amount of the working oil.

In example embodiments, the first control valve may be controlled to have a first orifice area during the single operation of the first actuator, and the first control valve may be controlled to have a second orifice area smaller than the first orifice area during the multiple operation of the first actuator.

In example embodiments, the controller may include a calculator configured to calculate the amount of the working oil to be supplied to the first actuator based on an inputted joystick displacement amount for the first and second actuators and state values in a hydraulic system, a joystick displacement converter configured to convert the inputted joystick displacement amount for the first actuator into a secondary joystick displacement amount corresponding to the calculated working oil amount, and an output portion configured to output the control signal for controlling the pilot signal pressure in proportion to the secondary joystick displacement amount.

In example embodiments, the first actuator may include any one of a boom cylinder, an arm cylinder and a bucket cylinder.

In example embodiments, the control system may further include a second hydraulic pump configured to supply a wording oil to the first and second actuators through third and fourth hydraulic lines, and third and fourth control valves installed in the third and fourth hydraulic lines and configured to control operations of the first and second actuators according to a displacement amount of each of spools therein.

According to example embodiments, in a control method for construction machinery, a hydraulic system including first and second actuators connected to the first hydraulic pump through first and second hydraulic lines respectively, and first and second control valves installed in the first and second hydraulic lines respectively and configured to control operations of the first and second actuators is prepared. Whether a single or multiple operation by self-load of the first actuator is to be performed is determined. An amount of a working oil to be supplied to the first actuator is calculated based on the operation of the first actuator. A spool displacement amount of the first control valve is adjusted according to the calculated amount of the working oil.

In example embodiments, adjusting the spool displacement amount of the first control valve may include performing a meter-out opening area control of the first control valve in proportion to the calculated amount of the working oil.

In example embodiments, calculating the amount of the working oil to be supplied to the first actuator may include calculating a first amount of the working oil to be supplied to the first actuator during a single operation of the first actuator, and calculating a second amount of the working oil to be supplied to the first actuator during a multiple operation of the first actuator, the first amount of the working oil being greater than the second amount of the working oil.

In example embodiments, adjusting the spool displacement amount of the first control valve may include controlling the first control valve to have a first orifice area during the single operation of the first actuator, and controlling the first control valve to have a second orifice area smaller than the first orifice area during the multiple operation of the first actuator.

In example embodiments, adjusting the spool displacement amount of the first control valve according to the calculated amount of the working oil may include converting the inputted joystick displacement amount for the first actuator into a secondary joystick displacement amount corresponding to the calculated working oil amount, and outputting a control signal for controlling a pilot signal pressure in proportion to the secondary joystick displacement amount.

In example embodiments, the method may further include supplying the pilot signal pressure for controlling the spool displacement amount of the first control valve corresponding to the secondary joystick displacement amount, to a spool of the first control valve In example embodiments, the first actuator may include any one of a boom cylinder, an arm cylinder and a bucket cylinder.

According to example embodiments, when the first actuator performs a single or multiple operation by self-load, a meter-out opening area control of a first control valve may be performed in proportion to an amount of a working oil to be supplied to the first actuator. That is, an orifice area curve with respect to a spool displacement of the first control valve may be designed based on a case that the amount of the working oil is a maximum amount or relatively greater, and in case that the amount of the working oil is relatively smaller, for example, during an operation by self-load, the orifice area (meter-out opening area) may be controlled to be decreased, to thereby prevent cavitation, while in case that the amount of the working oil is relatively greater, for example, during a load operation, the orifice area (meter-out opening area) may be controlled to be increased, to thereby improve fuel efficiency.

Accordingly, the meter-out opening area may be designed based on the amount of the working oil to be supplied to the actuator and the meter-out opening area may be controlled in proportion to the reduced amount of the working oil during a multiple operation, to thereby prevent cavitation from occurring due to the reduced amount of the working oil during the multiple operation. Further, the meter-out opening area may be controlled to be increased in case of the load operation such as an excavation operation to reduce back pressure, thereby improving fuel efficiency.

BRIEF DESCRIPTION OF THE DRAWINGS

Example embodiments will be more clearly understood from the following detailed description taken in conjunction with the accompanying drawings.

DETAILED DESCRIPTION

Figure 1:
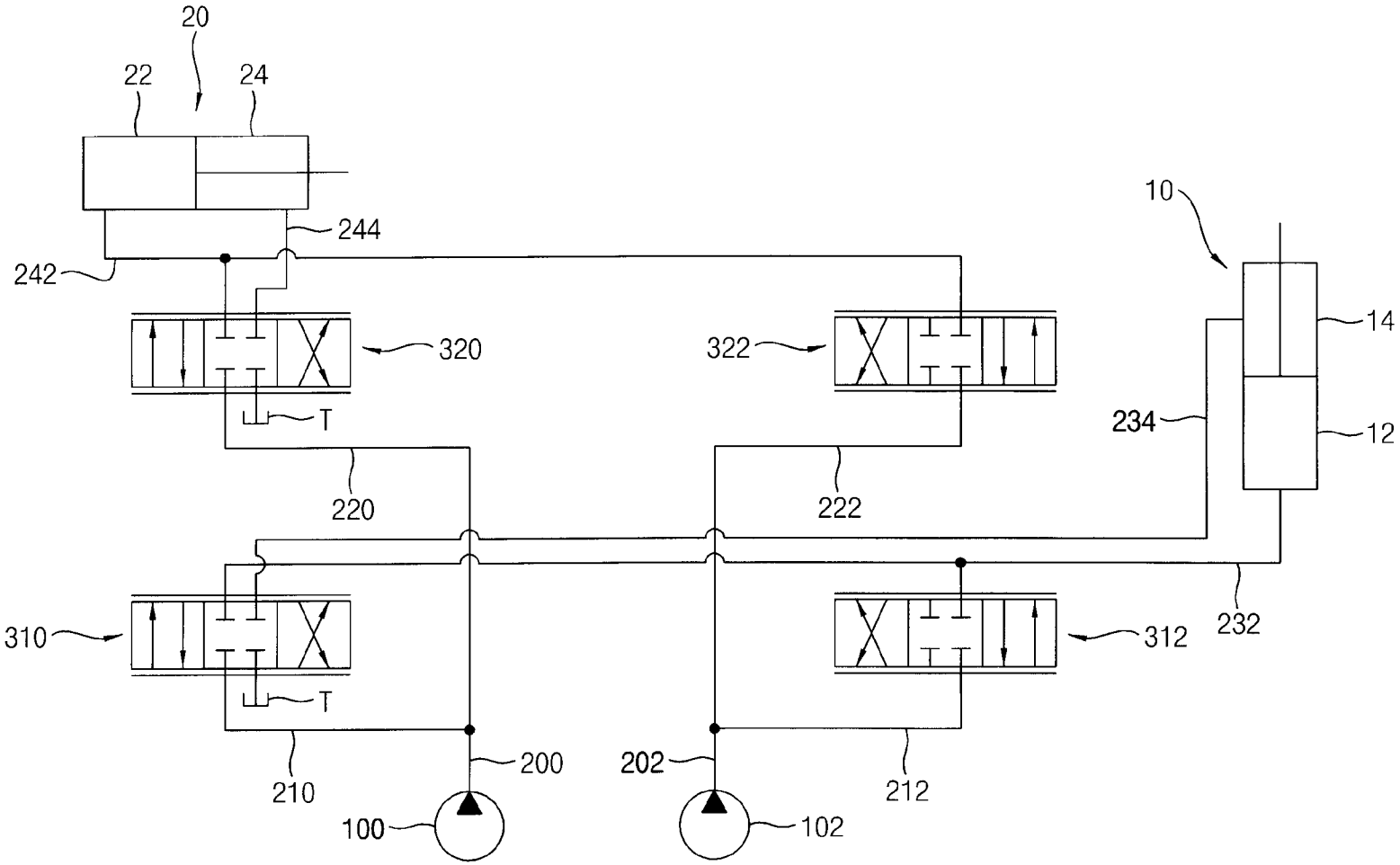
FIG. 1 is a hydraulic circuit diagram illustrating a hydraulic system of construction machinery in accordance with example embodiments.

Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
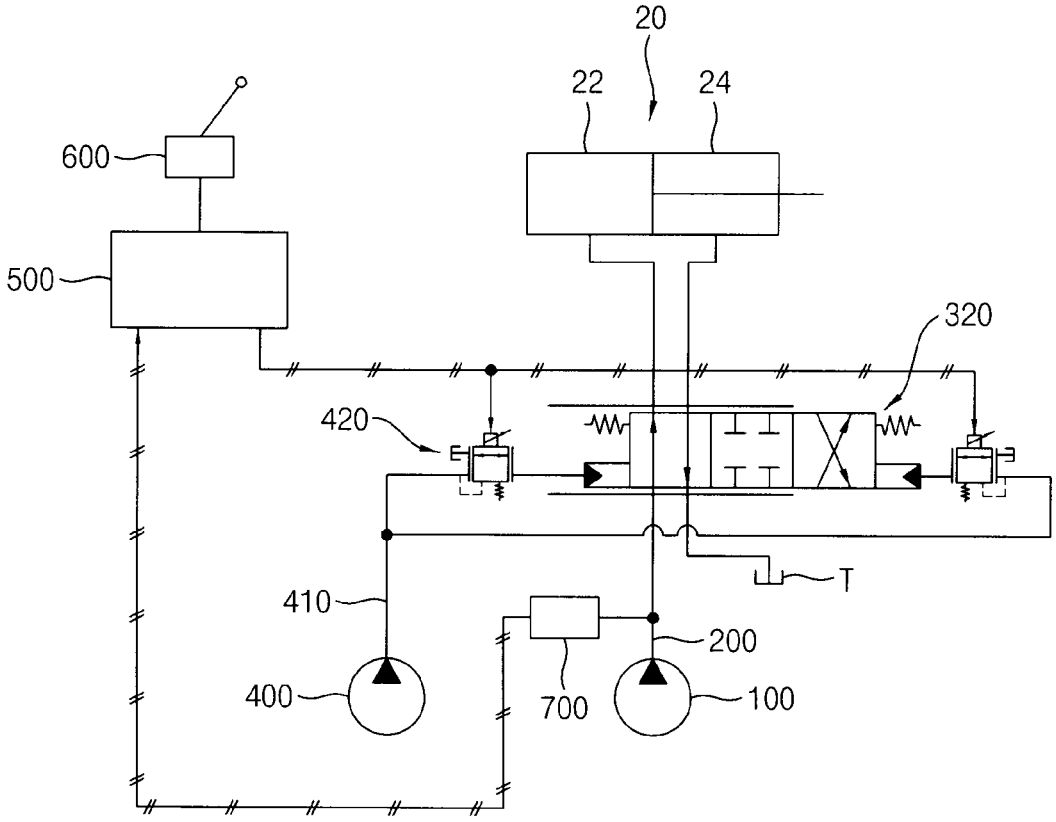
FIG. 2 is a view illustrating a control system for controlling the hydraulic system of construction machinery in FIG. 1.
Figure 3:
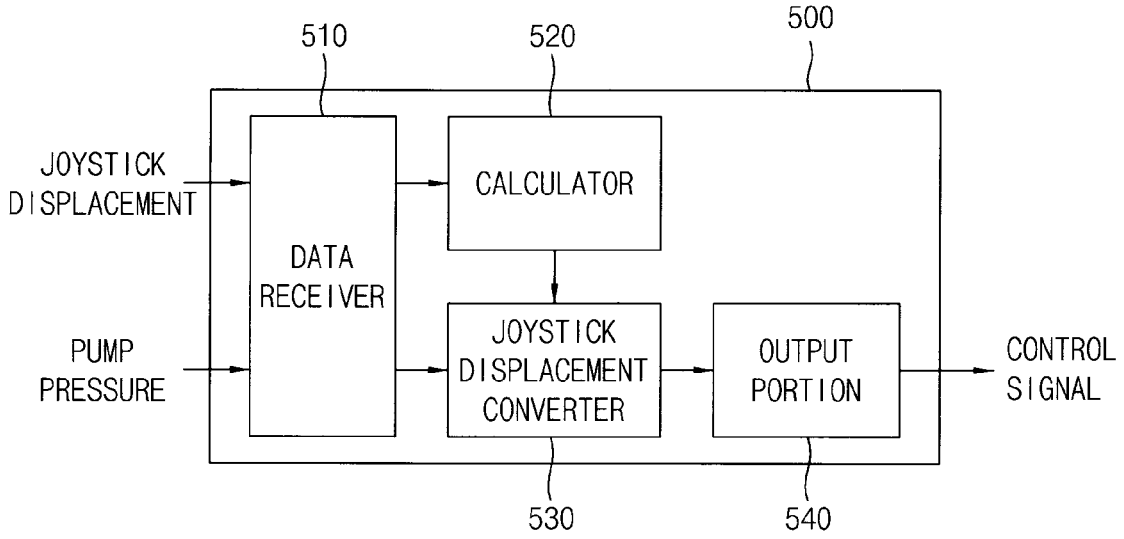
FIG. 3 is a block diagram illustrating a controller of the control system in FIG. 2.
Figure 4:
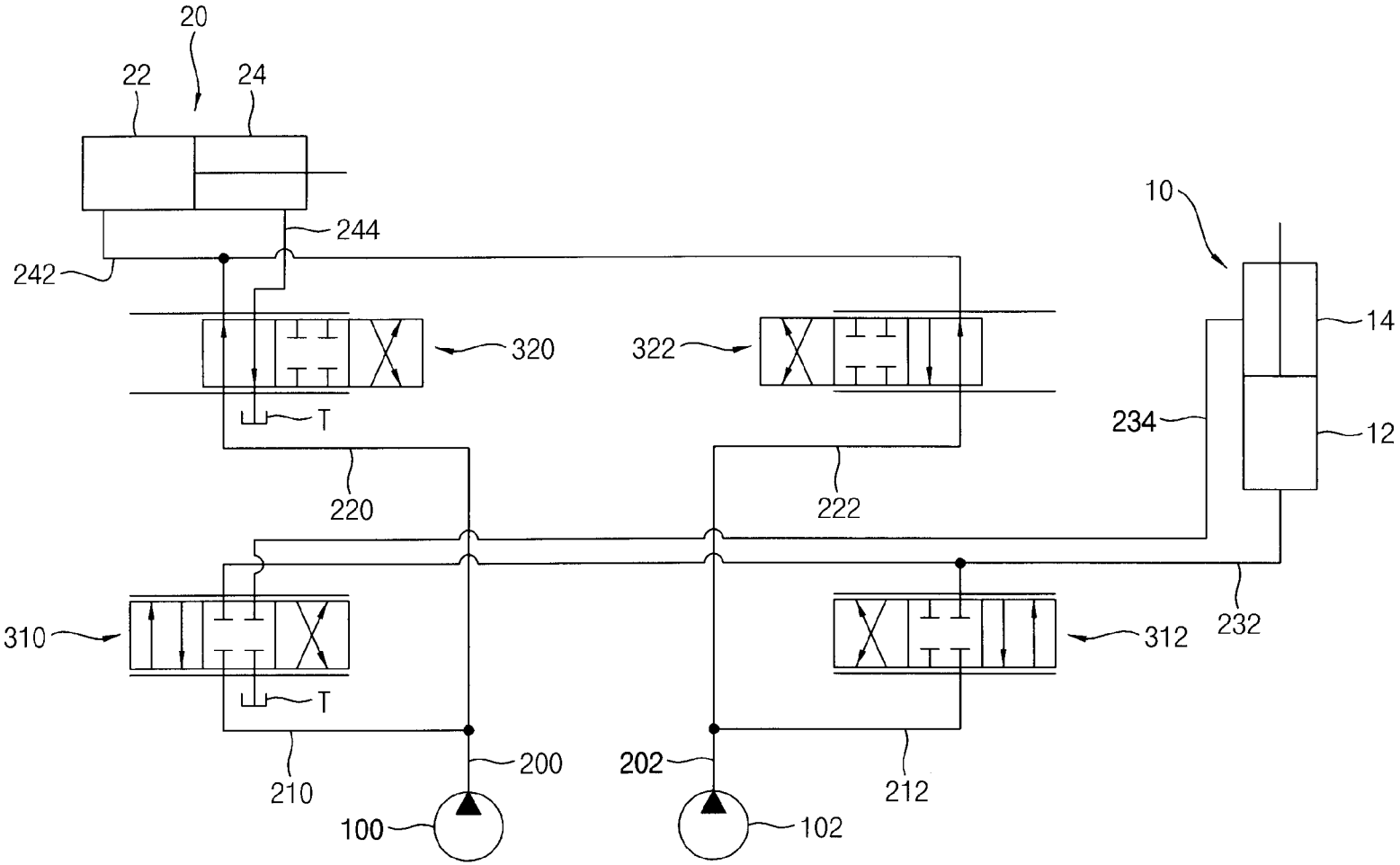
FIG. 4 is a hydraulic circuit diagram illustrating the hydraulic system in FIG. 1 where an arm cylinder performs a single operation by self-load.
Figure 5:
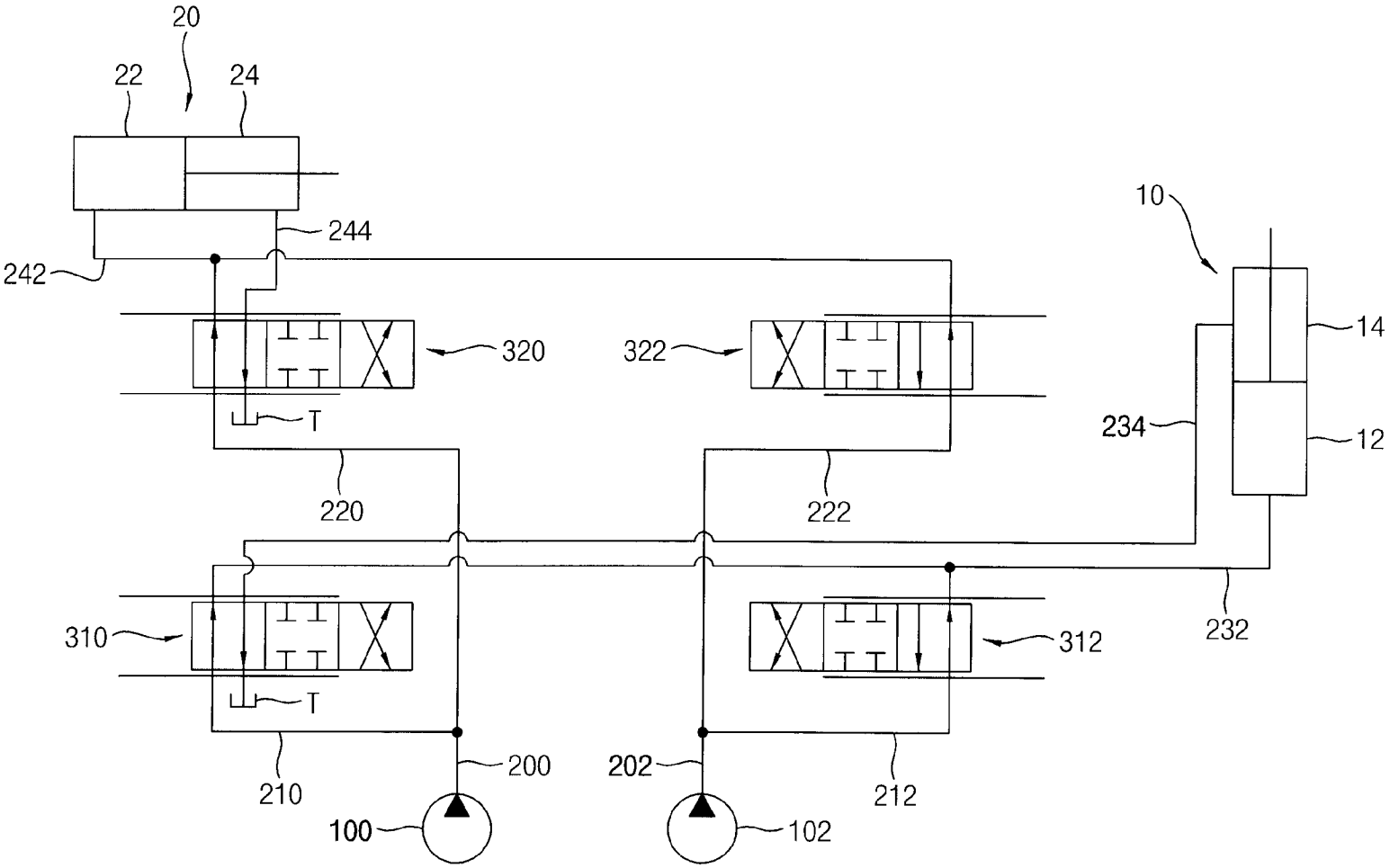
FIG. 5 is a hydraulic circuit diagram illustrating the hydraulic system in FIG. 1 where an arm cylinder performs a multiple operation by self-load.
Figure 6:
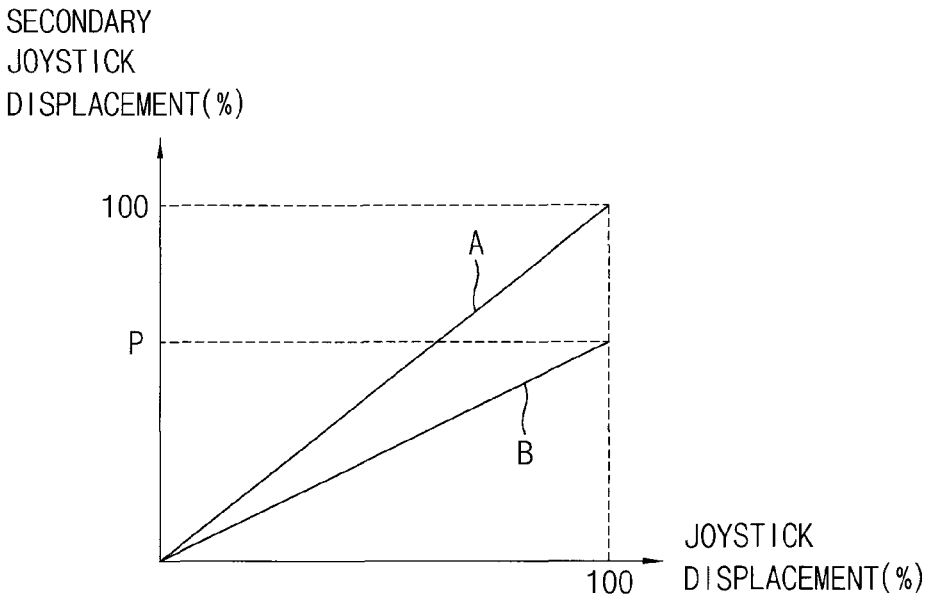
FIG. 6 is a graph illustrating an arm joystick displacement limit map in FIGS. 4 and 5.
Figure 7:
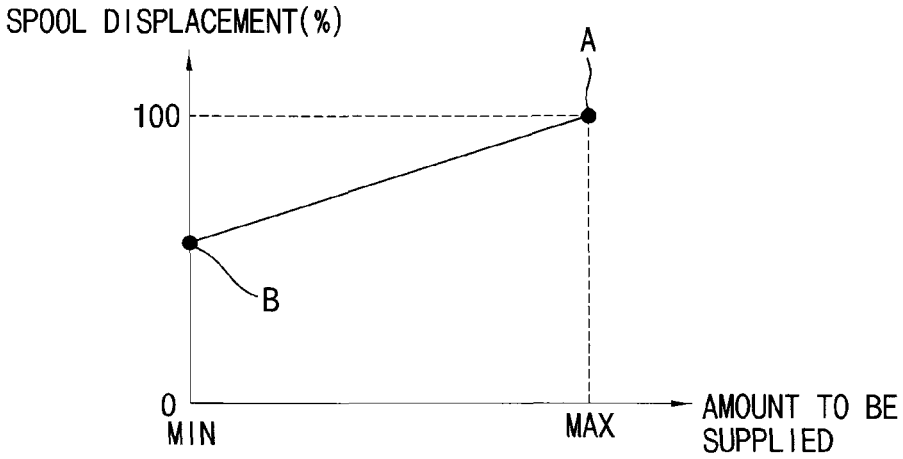
FIG. 7 is a graph illustrating a spool displacement amount of an arm control valve according to an amount of a working oil to be supplied to the arm cylinder in FIGS. 4 and 5.
Figure 8:
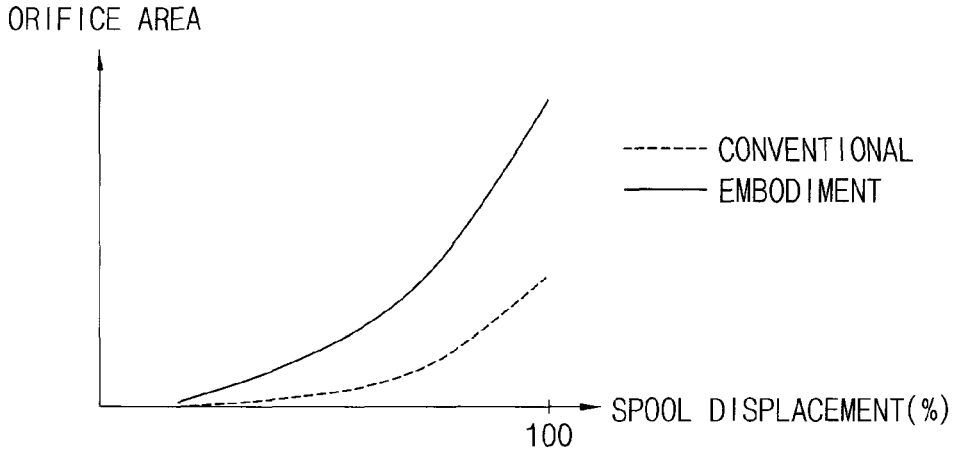
FIG. 8 is a graph illustrating an orifice area curve of a convention arm control valve and an orifice area curve of an arm control valve in accordance with example embodiments.

FIG. 1 is a hydraulic circuit diagram illustrating a hydraulic system of construction machinery in accordance with example embodiments. FIG. 2 is a view illustrating a control system for controlling the hydraulic system of construction machinery in FIG. 1. FIG. 3 is a block diagram illustrating a controller of the control system in FIG. 2. FIG. 4 is a hydraulic circuit diagram illustrating the hydraulic system in FIG. 1 where an arm cylinder performs a single operation by self-load. FIG. 5 is a hydraulic circuit diagram illustrating the hydraulic system in FIG. 1 where an arm cylinder performs a multiple operation by self-load. FIG. 6 is a graph illustrating an arm joystick displacement limit map in FIGS. 4 and 5. FIG. 7 is a graph illustrating a spool displacement amount of an arm control valve according to an amount of a working oil to be supplied to the arm cylinder in FIGS. 4 and 5. FIG. 8 is a graph illustrating an orifice area curve of a convention arm control valve and an orifice area curve of an arm control valve in accordance with example embodiments.

Referring to FIGS. 1 to 8, a control system for construction machinery may include a first hydraulic pump 100, first and second actuators 10 and 20 connected to the first hydraulic pump 100 through first and second hydraulic lines 210 and 220 respectively and operable by a working oil discharged from the first hydraulic pump 100, first and second control valves 310 and 320 installed in the first and second hydraulic lines 210 and 220 respectively and configured to control operations of the first and second actuators 10 and 20, a first spool displacement adjusting valve and a second spool displacement adjusting valve 420 supplying pilot signal pressures to spools of the first and second control valves 310 and 320 respectively in proportion to an inputted control signal to control displacement amounts of the spools of the first and second control valves 310 and 320, and a controller 500 configured to output the control signal to each of the first and second spool displacement adjusting valves corresponding to a manipulation signal of an operator.

In example embodiments, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

The construction machinery may include a lower travelling body, an upper swinging body mounted to be capable of swinging on the lower travelling body, and a cabin and a front working device installed in the upper swinging body. The front working device may include a boom, an arm and a bucket. A boom cylinder for controlling a movement of the boom may be installed between the boom and the upper swinging body. An arm cylinder for controlling a movement of the arm may be installed between the arm and the boom. A bucket cylinder for controlling a movement of the bucket may be installed between the bucket and the arm. As the boom cylinder, the arm cylinder and the bucket cylinder may expand or contract, the boom, the arm and the bucket may implement various movements, to thereby perform various works.

In example embodiments, the first hydraulic pump 100 may be connected to an engine (not illustrated) through a power take off (PTO) such that a power of the engine may be transferred to the first hydraulic pump 100. The working oil discharged from the first hydraulic pump 100 may be supplied to the first and second actuators 10 and 20 through the first and second control valves 310 and 320 respectively.

In particular, the first and second control valves 310 and 320 may be connected to the first hydraulic pump 100 through a first main hydraulic line 200. The first main hydraulic line 200 may be divided into the first and second hydraulic lines 210 and 220.

The first and second control valves 310 and 320 may be installed respectively in the first and second hydraulic lines 210 and 220 which are connected to the first hydraulic pump 100 in parallel with each other. When the first and second control valves 310 and 320 are switched, the working oil may be supplied to the first and second actuators 10 and 20 through the first and second control valves 310 and 320 respectively.

Although it is not illustrated in the figures, an auxiliary control valve for controlling an operation of a third actuator may be installed in a hydraulic line connected to the first hydraulic pump 100, and the working oil discharged from the first hydraulic pump 100 may be supplied to the third actuator through the auxiliary control valve.

In example embodiments, the first actuator 10 may be the boom cylinder, and the second actuator 20 may be the arm cylinder. In this case, the first control valve 310 may be a boom control valve, and the second control valve 320 may be an arm control valve.

The first control valve 310, that is, the boom control valve may be connected to the first actuator 10, that is, a boom head chamber 12 and a boom rod chamber 14 of the boom cylinder through a boom head hydraulic line 232 and a boom rod hydraulic line 234. Accordingly, the first control valve 310 may be switched to selectively supply the working oil discharged from the first hydraulic pump 100 to the boom head chamber 12 and the boom rod chamber 14.

The working oil which drives the boom cylinder 10 may return to a drain tank T through a return hydraulic line. For example, during a boom up operation the working oil from the boom rod chamber 14 may be drained to the drain tank T through the boom rod hydraulic line 234 via the first control valve 310, that is, the boom control valve.

The second control valve 320, that is, the arm control valve may be connected to the second actuator 20, that is, an arm head chamber 22 and an arm rod chamber 24 of the arm cylinder through an arm head hydraulic line 242 and an arm rod hydraulic line 244. Accordingly, the second control valve 320 may be switched to selectively supply the working oil discharged from the first hydraulic pump 100 to the arm head chamber 22 and the arm rod chamber 24.

The working oil which drives the arm cylinder 20 may return to the drain tank T through a return hydraulic line. For example, during an arm crowd operation the working oil from the arm rod chamber 24 may be drained to the drain tank T through the arm rod hydraulic line 244 via the second control valve 320, that is, the arm control valve.

As illustrated in FIG. 2, in example embodiments, a pilot pump 400 may be connected to an output axis of the engine. As the output axis of the engine rotates, the pilot pump 400 may be driven to discharge a pilot working oil. For example, the pilot pump may include a gear pump. In this case, the working oil and the pilot working oil may include substantially the same material.

The pilot working oil discharged from the pilot pump 400 may be supplied to the spool of the second control valve 320 via the second spool displacement adjusting valve 420. The pilot working oil discharged from the pilot pump 400 may be supplied to the second spool displacement adjusting valve 420 through a control line 410. The second spool displacement adjusting valve 420 may supply the pilot signal pressure to the spool of the second control valve 320 in proportion to the inputted control signal to control the displacement amount of the spool of the second control valve 320.

For example, a pair of the second spool displacement adjusting valves 420 may be provided in both sides of the spool of the second control valve 320. A first pilot signal pressure outputted from the second spool displacement adjusting valve 420 may be supplied selectively to both sides of the spool, to switch the second control valve 320. The second spool displacement adjusting valve 420 may supply the pilot signal pressure in proportion to the inputted control signal. The movement of the spool of the second control valve 320 may be controlled by the pilot signal pressure. That is, the movement direction of the spool may be determined by a supply direction of the pilot signal pressure, and the displacement amount of the spool may be determined by the magnitude of the pilot signal pressure.

Although it is not illustrated in the figures, similarly to the second spool displacement adjusting valve 420, the pilot working oil discharged from the pilot pump 400 may be supplied to the spool of the first control valve 310 via the first spool displacement adjusting valve. The pilot working oil discharged from the pilot pump 400 may be supplied to the first spool displacement adjusting valve through the control line 410. The first spool displacement adjusting valve may supply the pilot signal pressure to the spool of the first control valve 310 in proportion to the inputted control signal to control the displacement amount of the spool of the first control valve 310.

A pair of the first spool displacement adjusting valves may be provided in both sides of the spool of the first control valve 310. A pilot signal pressure outputted from the first spool displacement adjusting valve may be supplied selectively to both sides of the spool, to switch the first control valve 310. The first spool displacement adjusting valve may supply the pilot signal pressure in proportion to the inputted control signal. The movement of the spool of the first control valve 310 may be controlled by the pilot signal pressure. That is, the movement direction of the spool may be determined by a supply direction of the pilot signal pressure, and the displacement amount of the spool may be determined by the magnitude of the pilot signal pressure.

In example embodiments, the control system for construction machinery may include a main control valve (MCV) as an assembly including the first and second control valves 310 and 320. The main control valve may be an electro-hydraulic main control valve including an electro proportional pressure reducing valve (EPPRV) which controls a pilot working oil supplied to the spool of the control valve according to an inputted electrical signal. The first and second spool displacement adjusting valves may include an electro proportional pressure reducing valve (EPPRV).

In example embodiments, the controller 500 may receive the manipulation signal in proportion to a manipulation amount of an operator, and may output a pressure command signal as the control signal to the first and second spool displacement adjusting valves corresponding to the manipulation signal. The electro proportional pressure reducing valves may output a secondary pressure in proportion to the pressure command signal to the corresponding spools, to control the spools using electrical signals.

For example, the controller 520 may receive a manipulation signal for the first actuator 10, for example, a first joystick displacement amount, and generate and apply a control signal corresponding to the first joystick displacement amount, for example, current to the first spool displacement adjusting valve. The first spool displacement adjusting valve may supply a pilot signal pressure in proportion to the applied current to the spool of the first control valve 310 to move the spool according to the supplied pilot signal pressure. Accordingly, the first joystick displacement amount for the first actuator 10 may be converted into a spool displacement amount of the first control valve 310 at a predetermined conversion ratio.

The controller 500 may receive a manipulation signal for the second actuator 20, for example, a second joystick displacement amount, and generate and apply a control signal corresponding to the second joystick displacement amount, for example, current to the second spool displacement adjusting valve 420. The second spool displacement adjusting valve 420 may supply a pilot signal pressure in proportion to the applied current to the spool of the second control valve 320 to move the spool according to the supplied pilot signal pressure. Accordingly, a second joystick displacement amount for the second actuator 20 may be converted into a spool displacement amount of the second control valve 320 at a predetermined conversion ratio.

For example, a manipulation portion 600 may include a joystick, a pedal, etc. When an operator manipulates the manipulation portion 600, a manipulation signal corresponding to the manipulation may be generated. The manipulation portion 600 may include a sensor for detecting the joystick displacement amount (or angle). The manipulation portion 600 may output a signal such as a voltage signal or a current signal corresponding to the detected displacement amount. The controller 500 may receive the manipulation signal and control the main control valve corresponding to the manipulation signal, to operate the first and second actuators.

In example embodiments, the control system for construction machinery may further include a second hydraulic pump 102 for supplying a wording oil to the first and second actuators 10 and 20, a third control valve 312 installed in a third hydraulic line 212 between the first actuator 10 and the second hydraulic pump 102 and configured to control an operation of the first actuator 10, a fourth control valve 322 installed in a fourth hydraulic line 222 between the second actuator 20 and the second hydraulic pump 102 and configured to control an operation of the second actuator 20, and third and fourth spool displacement adjusting valves supplying pilot signal pressures to spools of the third and fourth control valves 312 and 322 respectively in proportion to an inputted control signal to control displacement amounts of the spools of the third and fourth control valves 312 and 322.

The second hydraulic pump 102 may be connected to the engine which drives the first hydraulic pump 100. The working oil discharged from the second hydraulic pump 102 may be supplied to the first and second actuators 10 and 20 through the third and fourth control valves 312 and 322 respectively.

In particular, the third and fourth control valves 312 and 322 may be connected to the second hydraulic pump 102 through a second main hydraulic line 202. The second main hydraulic line 202 may be divided into third and fourth hydraulic lines 212 and 222.

The third and fourth control valves 312 and 322 may be installed respectively in the third and fourth hydraulic lines 212 and 222 which are connected to the second hydraulic pump 102 in parallel with each other. When the third and fourth control valves 312 and 322 are switched, the working oil from the second hydraulic pump 102 may be supplied to the first and second actuators 10 and 20 through the third and fourth control valves 312 and 322 respectively.

Although it is not illustrated in the figures, an auxiliary control valve for controlling an operation of a fourth actuator may be installed in a hydraulic line connected to the second hydraulic pump 100, and the working oil discharged from the second hydraulic pump 102 may be supplied to the fourth actuator through the auxiliary control valve.

In example embodiments, the third control valve 312 may be a boom control valve, and the fourth control valve 322 may be an arm control valve. When the arm performs a multiple operation (for example, arm crowd operation and boom up operation), the second control valve 320 may be a main arm control valve, and the fourth control valve 322 may be an auxiliary arm control valve. In this case, an amount of the working oil supplied to the arm cylinder 20 through the second control valve 320 may be relatively greater than an amount of the working oil supplied to the arm cylinder 20 through the fourth control valve 322. When the boom performs a multiple operation (for example, boom up operation and arm crowd operation), the first control valve 310 may be an auxiliary boom control valve, and the third control valve 320 may be a main boom control valve. In this case, an amount of the working oil supplied to the boom cylinder 10 through the third control valve 312 may be relatively greater than an amount of the working oil supplied to the boom cylinder 10 through the first control valve 310.

Similarly to the second spool displacement adjusting valve 420, the pilot working oil discharged from the pilot pump 400 may be supplied to the spools of the third and fourth control valves 312 and 322 via the third and fourth spool displacement adjusting valves. The third and fourth spool displacement adjusting valves may supply the pilot signal pressures to the spools of the third and fourth control valves 312 and 322 in proportion to inputted control signals to control the displacement amounts of the spools of the third and fourth control valves 312 and 322 respectively. For example, the third and fourth spool displacement adjusting valves may include an electro proportional pressure reducing valve (EPPRV).

In example embodiments, the controller 500 may control a spool displacement amount of the second control valve 320 according to an amount of the working oil to be supplied to the second actuator 20 when the second actuator 20 performs a single or multiple operation by self-load. The controller 500 may perform a meter-out opening area control of the first control valve 320 in proportion to the amount of the working oil to be supplied to the second actuator 20.

As illustrated in FIG. 3, the controller 500 may include a data receiver 510, a calculator 520, a joystick displacement converter 530 and an output portion 540.

The data receiver 510 may receive a joystick displacement from the manipulation portion 600. The data receiver 510 may receive the joystick displacement amount as a manipulation signal for the boom, the arm, the bucket, etc. For example, the data receiver 510 may receive an arm joystick displacement amount as the manipulation signal for the boom cylinder. Additionally, the data receiver 510 may receive state values in the hydraulic system, for example, pressures of the first and second hydraulic pumps 100 and 102 or the pressures of the first and second actuators. For example, the data receiver 510 may receive a discharge pressure of the working oil discharged from the first and second hydraulic pumps 100 and 102 from a pressure sensor 700.

The calculator 520 may determine whether or not a single or multiple operation by self-load of the second actuator 20 is to be performed, from the inputted joystick displacement amount for the first and second actuators and the state values, for example, the discharge pressures of the first and second hydraulic pumps, and may calculate an amount of the working oil to be supplied to the second actuator 20 based on the determined operation of the second actuator 20.

Alternatively, the calculator 520 may determine whether or not a single or multiple operation of the actuator is to be performed, based on the pressures of the first and second actuators, for example, a pressure difference between a head chamber pressure and a rod chamber pressure.

For example, the calculator 520 may determine the amount of the working oil to be supplied to the second actuator 20 as a maximum amount of the working oil when it is determined that a single operation by self-load of the second actuator 20 is to be performed, and may calculate the amount of the working oil to be supplied to each of the first and second actuators 10 and 20 in proportion to the joystick displacement amount when it is that a multiple operation by self-load of the second actuator 20 with the first actuator 10 is to be performed.

The joystick displacement converter 530 may convert the inputted joystick displacement amount for the second actuator 20 into a secondary joystick displacement amount corresponding to the calculated working oil amount. The joystick displacement converter 530 may convert the inputted joystick displacement amount for the second actuator 20 into the secondary joystick displacement amount using a displacement limit map when it is determined that an operation by self-load of the second actuator 20 is to be performed. The inputted joystick displacement amount may be converted into the secondary joystick displacement amount at a predetermined ratio corresponding to a distributed working oil amount, which is stored in the displacement limit map.

The output portion 540 may output the control signal for controlling the pilot signal pressure in proportion to the converted (limited) secondary joystick displacement amount. The output portion 540 may generate and apply current in proportion to the converted secondary joystick displacement amount to the second spool displacement adjusting valve 420. The second spool displacement adjusting valve 420 may supply the pilot signal pressure in proportion to the applied current to the spool of the second control valve 320 to move the spool of the second control valve 320 corresponding to the pilot signal pressure.

As illustrated in FIG. 4, when the arm cylinder 20 performs a single operation by self-load (for example, arm crowd operation), the arm cylinder 20 may receive the maximum amount of the working oil (for example, 100% working oil amount) from the first and second hydraulic pumps 100 and 102. In this case, the working oil from the first hydraulic pump 100 (for example, 50% working oil amount) may be supplied to the arm cylinder 20 through the second control valve 320 and the working oil from the second hydraulic pump 102 (for example, 50% working oil amount) may be supplied to the arm cylinder 20 through the fourth control valve 322.

As illustrated in FIG. 5, when the arm cylinder 20 perform a multiple operation by self-load (for example, arm crowd operation and boom up operation), the arm cylinder 20 may receive a predetermined amount of the working oil (for example, 50% working oil amount) from the first and second hydraulic pumps 100 and 102. In this case, the working oil from the first hydraulic pump 100 (for example, 40% working oil amount) may be supplied to the arm cylinder 20 through the second control valve 320 and the working oil from the second hydraulic pump 102 (for example, 10% working oil amount) may be supplied to the arm cylinder 20 through the fourth control valve 322. The working oil from the first hydraulic pump 100 (for example, 10% working oil amount) may be supplied to the boom cylinder 10 through the first control valve 310 and the working oil from the second hydraulic pump 102 (for example, 40% working oil amount) may be supplied to the boom cylinder 10 through the third control valve 312.

As illustrated in FIG. 6, an inputted arm joystick displacement amount may be converted into a secondary arm joystick displacement amount at a predetermined ratio corresponding to a working oil amount distributed to the arm cylinder 20, which is stored in the displacement limit map. When the arm cylinder 20 performs a single operation by self-load (arm crowd operation) (Graph A), an inputted arm joystick displacement amount (0~100%) may be mapped into a secondary arm joystick displacement amount (0~100%). When the arm cylinder 20 performs a multiple operation by self-load (arm crowd operation and boom up operation) (Graph B), an inputted arm joystick displacement amount (0~100%) may be mapped into a secondary arm joystick displacement amount (0~P %). A reduction ratio of the secondary arm joystick displacement amount with respect to the inputted arm joystick displacement amount may be in proportion to the calculated working oil amount. That is, as the amount of the working oil supplied to the arm cylinder 20 is decreased, the converted secondary arm joystick displacement amount may be decreased.

As illustrated in FIG. 7, a spool displacement amount of the arm control valve 320 may be adjusted according to the amount of the working oil to be supplied to the arm cylinder 20. When the arm cylinder 20 performs a single operation by self-load (arm crowd operation) (Point A), the spool displacement amount (100% maximum allowable amount) of the arm control valve 320 with respect to the arm joystick displacement amount may be adjusted according to the amount (MAX) of the working oil to be supplied to the arm cylinder 20. When the arm cylinder 20 performs a multiple operation by self-load (arm crowd operation and boom up operation) (Point B), as the amount of the working oil supplied to the arm cylinder 20 is decreased, the maximum allowable amount of the spool displacement amount of the arm control valve 320 with respect to the arm joystick displacement amount may be decreased.

As illustrated in FIG. 8, an orifice area curve (represented as a dotted line) of a conventional arm control valve 320 was designed based on cavitation prevention. An orifice area curve (represented as a solid line) of an arm control valve 320 according to example embodiments may be designed based on a maximum amount of a working oil to be supplied. Accordingly, the orifice area curve of the arm control valve according to example embodiments may have an opening area greater than the conventional orifice area curve.

As mentioned above, the control system for construction machinery may include first and second control valves configured to control operations of first and second actuators and an electro-hydraulic main control valve including electro proportional pressure reducing valves which control a pilot working oil supplied to spools of the first and second control valves corresponding to an inputted electrical signal. The control system for construction machinery may perform a meter-out opening area control of the first control valve in proportion to the working oil to be supplied to the first actuator when the first actuator performs a single or multiple operation by self-load.

Accordingly, pressure loss due to a relatively small orifice area in a conventional orifice may be prevented from occurring during a load operation, an orifice area curve may be designed based on an amount of the working oil to be supplied to the actuator, and the meter-out opening area control may be performed in proportion to the reduced amount of the working oil during a multiple operation, to thereby prevent cavitation from occurring due to the reduced amount of the working oil during the multiple operation.

It may be illustrated that the above embodiments may be applied to control the arm control valve during an arm crowd operation by self-load, however, it may not be limited thereto. For example, example embodiments may be applied to other operations such as boom down by self-load, bucket crowd by self-load, etc.

Hereinafter, a control method for construction machinery using the control system in FIGS. 1 and 2 will be explained.

Figure 9:
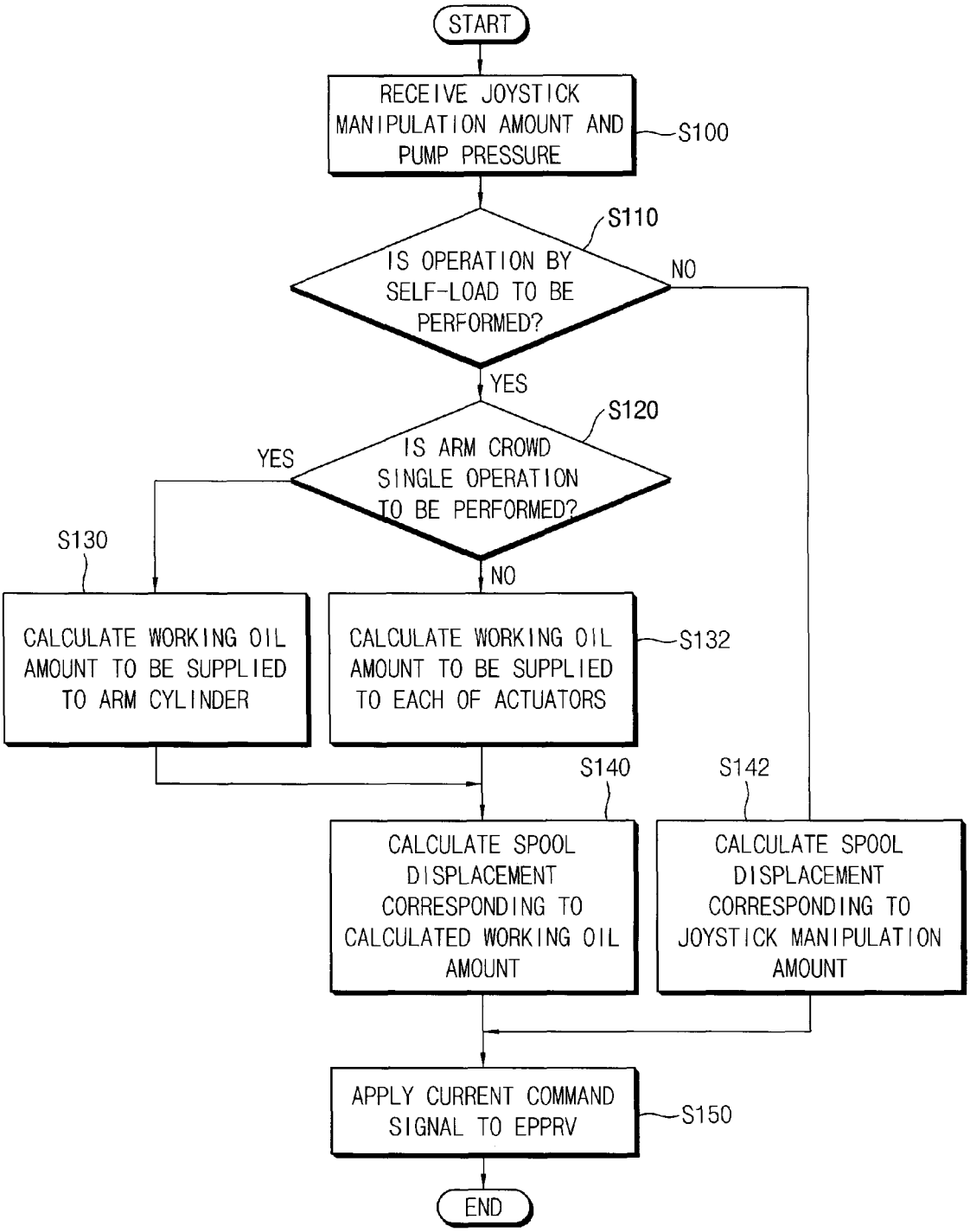
FIG. 9 is a flow chart illustrating a control method for construction machinery in accordance with example embodiments.

FIG. 9 is a flow chart illustrating a control method for construction machinery in accordance with example embodiments.

Referring to FIGS. 1, 2 and 9, a manipulation signal of an operator for first and second actuators 10 and 20 and discharge pressures of first and second hydraulic pumps 100 and 102 may be received (S100).

In example embodiments, the manipulation signal for the first and second actuators 10 and 20 may be received through a manipulation portion 600. A boom joystick displacement amount as the manipulation signal for a boom cylinder and an arm joystick displacement amount as the manipulation signal for an arm cylinder may be received. The discharge pressures of the first hydraulic pump 100 and the second hydraulic pump 102 may be received. Alternatively, pressures of the boom cylinder and the arm cylinder may be received.

Then, whether or not a single or multiple operation by self-load of the second actuator 20 is to be performed may be determined (S110, S120), and an amount of a working oil to be supplied to the second actuator 20 may be calculated based on the operation of the second actuator 20 (S130, S132).

Whether or not a single or multiple operation by self-load of the second actuator 20 is to be performed may be determined from the inputted joystick displacement amount for the first and second actuators 10 and 20 and the discharge pressures of first and second hydraulic pumps 100 and 102, and the amount of the working oil to be supplied to the second actuator 20 may be calculated based on the determined operation of the second actuator 20.

The amount of the working oil to be supplied to the second actuator when it is determined that a single operation by self-load of the second actuator 20 is to be performed may be determined as a predetermined amount of the working oil (for example, a maximum amount of the working oil), and the amount of the working oil to be supplied to each of the first and second actuators 10 and 20 may be calculated in proportion to the joystick displacement amount when it is that a multiple operation by self-load of the second actuator 20 with the first actuator 10 is to be performed.

For example, when the arm cylinder 20 performs a single operation by self-load (for example, arm crowd operation), the arm cylinder 20 may receive the maximum amount of the working oil (for example, 100% working oil amount) from the first and second hydraulic pumps 100 and 102. When the arm cylinder 20 perform a multiple operation by self-load (for example, arm crowd operation and boom up operation), the arm cylinder 20 may receive a predetermined amount of the working oil (for example, 50% working oil amount) from the first and second hydraulic pumps 100 and 102 and the boom cylinder 10 may receive a predetermined amount of the working oil (for example, 50% working oil amount) from the first and second hydraulic pumps 100 and 102.

Then, a spool displacement amount of an arm control valve 320 may be adjusted according to the calculated amount of the working oil to be supplied to the arm cylinder 20 (S140), and current in proportion to the adjusted spool displacement amount may be generated and applied to a second spool displacement adjusting valve 420 (S150). On the other hand, when the second actuator 20 does not perform an operation by self-load, a spool displacement amount may be calculated according to a joystick manipulation amount (S142), and current in proportion to the calculated spool displacement amount may be generated and applied to the second spool displacement adjusting valve 420 (S150).

The inputted joystick displacement amount for the second actuator 20 may be converted into a secondary joystick displacement amount using a displacement limit map when it is determined that an operation by self-load of the second actuator 20 is to be performed. The inputted joystick displacement amount may be converted into the secondary joystick displacement amount at a predetermined ratio corresponding to a distributed working oil amount, which is stored in the displacement limit map.

For example, when the arm cylinder 20 performs a single operation by self-load (arm crowd operation), an inputted arm joystick displacement amount (0~100%) may be mapped into a secondary arm joystick displacement amount (0~100%). When the arm cylinder 20 performs a multiple operation by self-load (arm crowd operation and boom up operation), an inputted arm joystick displacement amount (0~100%) may be mapped into a secondary arm joystick displacement amount (0~P %). A reduction ratio of the secondary arm joystick displacement amount with respect to the inputted arm joystick displacement amount may be in proportion to the calculated working oil amount. That is, as the amount of the working oil supplied to the arm cylinder 20 is decreased, the converted secondary arm joystick displacement amount may be decreased.

The current in proportion to the converted secondary joystick displacement amount may be applied to the second spool displacement adjusting valve 420 as a control signal. The second spool displacement adjusting valve 420 may supply a pilot signal pressure in proportion to the applied current to a spool of the second control valve 320 to move the spool according to the supplied pilot signal pressure.

For example, a spool displacement amount of the arm control valve 320 may be adjusted according to the amount of the working oil to be supplied to the arm cylinder 20. When the arm cylinder 20 performs a single operation by self-load (arm crowd operation), the spool displacement amount of the arm control valve 320 may be determined as 100% maximum allowable amount). When the arm cylinder 20 performs a multiple operation by self-load (arm crowd operation and boom up operation), the spool displacement of the arm control valve 320 may be adjusted to be decreased according to the reduced amount of the working oil.

During an operation by self-load, an orifice area of the arm control valve 320 may be controlled according to the amount of the working oil to be supplied to the arm cylinder 20. During a single operation (A) of the arm cylinder 20, the arm control valve 320 may be controlled to have a first orifice area, and during a multiple operation (B) of the arm cylinder 20, the arm control valve 320 may be controlled to have a second orifice area smaller than the first orifice area.

Accordingly, when the second actuator 20 performs a single or multiple operation by self-load, a meter-out opening area control may be performed in proportion to an amount of the working oil to be supplied to the second actuator 20.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages of the present invention. Accordingly, all such modifications are intended to be included within the scope of example embodiments as defined in the claims.

What is claimed is:

1. A control system for construction machinery, the control system comprising:

a first hydraulic pump;

first and second actuators connected to the first hydraulic pump through first and second hydraulic lines respectively and operable by a working oil discharged from the first hydraulic pump;

first and second control valves installed in the first and second hydraulic lines respectively and configured to control operations of the first and second actuators;

first spool displacement adjusting valves supplying a pilot signal pressure to a spool of the first control valve in proportion to an inputted control signal to control a displacement amount of the spool of the first control valve; and a controller configured to output the control signal to the first spool displacement adjusting valves corresponding to a manipulation signal of an operator, and configured to adjust a spool displacement amount of the first control valve according to an amount of the working oil to be supplied to the first actuator when the first actuator performs a single or multiple operation by self-load, wherein the first actuator includes an arm cylinder and the second actuator includes a boom cylinder, wherein the controller is configured to adjust the spool displacement amount of the first control valve such that a first amount of the working oil is supplied to the arm cylinder through the first control valve when only an arm joystick is manipulated such that the arm cylinder performs an arm crowd operation in a direction of weight of an arm, wherein the controller is configured to adjust the spool displacement amount of the first control valve such that a second amount of the working oil less than the first amount of the working oil is supplied to the arm cylinder through the first control valve when the arm joystick and a boom joystick are manipulated at the same time such that the arm cylinder performs the arm crowd operation in the direction of weight of the arm and the boom cylinder performs a boom up operation, wherein when the arm joystick is manipulated such that the arm cylinder performs the arm crowd operation, the spool displacement amount of the first control valve is adjusted to have a first maximum allowable amount with respect to an arm joystick displacement amount, and wherein when the arm joystick and the boom joystick are manipulated at the same time such that the arm cylinder performs the arm crowd operation and the boom cylinder performs the boom up operation, the spool displacement amount of the first control valve is adjusted to have a second maximum allowable amount with respect to the arm joystick displacement amount which is less than the first maximum allowable amount.

2. The control system for construction machinery of claim 1, wherein the controller outputs the control signal to the first spool displacement adjusting valves to perform a meter-out opening area control of the first control valve.

3. The control system for construction machinery of claim 1, wherein the first control valve is controlled to have a first orifice area during the single operation of the first actuator, and the first control valve is controlled to have a second orifice area smaller than the first orifice area during the multiple operation of the first actuator.

4. The control system for construction machinery of claim 1, wherein the controller comprises:

a calculator configured to calculate the amount of the working oil to be supplied to the first actuator based on an inputted joystick displacement amount for the first and second actuators and state values in a hydraulic system;

a joystick displacement converter configured to convert the inputted joystick displacement amount for the first actuator into a secondary joystick displacement amount corresponding to the calculated working oil amount; and an output portion configured to output the control signal for controlling the pilot signal pressure in proportion to the secondary joystick displacement amount.

5. The control system for construction machinery of claim 1, further comprising:

a second hydraulic pump configured to supply a working oil to the first and second actuators through third and fourth hydraulic lines; and third and fourth control valves installed in the third and fourth hydraulic lines and configured to control operations of the first and second actuators according to a displacement amount of each of spools therein.

6. A control method for construction machinery, the method comprising:

providing a hydraulic system including first and second actuators connected to the first hydraulic pump through first and second hydraulic lines respectively, and first and second control valves installed in the first and second hydraulic lines respectively and configured to control operations of the first and second actuators;

determining whether a single or multiple operation by self-load of the first actuator is to be performed;

calculating an amount of a working oil to be supplied to the first actuator based on the operation of the first actuator; and adjusting a spool displacement amount of the first control valve according to the calculated amount of the working oil, wherein the first actuator includes an arm cylinder and the second actuator includes a boom cylinder, wherein adjusting the spool displacement amount of the first control valve comprises:

adjusting the spool displacement amount of the first control valve such that a first amount of the working oil is supplied to the arm cylinder through the first control valve when only an arm joystick is manipulated such that the arm cylinder performs an arm crowd operation in a direction of weight of an arm; and adjusting the spool displacement amount of the first control valve such that a second amount of the working oil less than the first amount of the working oil is supplied to the arm cylinder through the first control valve when the arm joystick and a boom joystick are manipulated at the same time such that the arm cylinder performs the arm crowd operation in the direction of weight of the arm and the boom cylinder performs a boom up operation, wherein when the arm joystick is manipulated such that the arm cylinder performs the arm crowd operation, the spool displacement amount of the first control valve is adjusted to have a first maximum allowable amount with respect to an arm joystick displacement amount, and wherein when the arm joystick and the boom joystick are manipulated at the same time such that the arm cylinder performs the arm crowd operation and the boom cylinder performs the boom up operation, the spool displacement amount of the first control valve is adjusted to have a second maximum allowable amount with respect to the arm joystick displacement amount which is less than the first maximum allowable amount.

7. The method of claim 6, wherein adjusting the spool displacement amount of the first control valve comprises performing a meter-out opening area control of the first control valve in proportion to the calculated amount of the working oil.

8. The method of claim 6, wherein calculating the amount of the working oil to be supplied to the first actuator comprises:

calculating the first amount of the working oil to be supplied to the first actuator during the single operation of the first actuator; and calculating the second amount of the working oil to be supplied to the first actuator during the multiple operation of the first actuator.

9. The method of claim 8, wherein adjusting the spool displacement amount of the first control valve comprises:

controlling the first control valve to have a first orifice area during the single operation of the first actuator; and controlling the first control valve to have a second orifice area smaller than the first orifice area during the multiple operation of the first actuator.

10. The method of claim 6, wherein adjusting the spool displacement amount of the first control valve according to the calculated amount of the working oil comprises:

converting the inputted joystick displacement amount for the first actuator into a secondary joystick displacement amount corresponding to the calculated working oil amount; and outputting a control signal for controlling a pilot signal pressure in proportion to the secondary joystick displacement amount.

11. The method of claim 10, further comprising supplying the pilot signal pressure for controlling the spool displacement amount of the first control valve corresponding to the secondary joystick displacement amount, to a spool of the first control valve.

12. The method of claim 6, further comprising:

providing a second hydraulic pump configured to supply a working oil to the first and second actuators through third and fourth hydraulic lines, and third and fourth control valves installed in the third and fourth hydraulic lines and configured to control operations of the first and second actuators according to a displacement amount of each of spools therein.

* * * * *